United States Patent [19]

Belt

[11] Patent Number: 4,606,432

[45] Date of Patent: Aug. 19, 1986

[54] ADJUSTABLE LADDER LEG

[76] Inventor: Ned W. Belt, 3501 Crestwood Dr., Cleveland, Tenn. 37311

[21] Appl. No.: 619,352

[22] Filed: Oct. 29, 1984

[51] Int. Cl.[4] ..... E06C 7/44

[52] U.S. Cl. ..... 182/204; 248/188.8

[58] Field of Search ..... 182/204, 205, 203, 201, 182/188.2, 188.8; 248/210

[56] References Cited

U.S. PATENT DOCUMENTS

| | | | |
|---|---|---|---|
| 2,936,849 | 5/1960 | Larson | 182/204 |
| 3,484,814 | 12/1969 | Meehan | 182/204 |
| 3,861,500 | 1/1975 | Dempsey | 182/204 |
| 3,948,352 | 4/1976 | Larson | 182/204 |
| 3,998,293 | 12/1976 | Raia | 182/204 |
| 4,209,078 | 6/1980 | Gerber | 182/204 |

*Primary Examiner*—Reinaldo P. Machado
*Attorney, Agent, or Firm*—Alan Ruderman

[57] ABSTRACT

A ladder leveling leg has a universal clamping arrangement adapted for fastening to the rail of a ladder of various cross sectional configurations. The leg is adjustably mounted within a guide channel secured to brackets to which a clamping member is adjustably fastened to lock the guide channel to the rail of the ladder. The leveling leg is slidably mounted within the channel and may be secured thereto in selected positions by means of a detent resiliently urged toward cooperating holes in the leveling leg and the channel. Gripping members on the clamping member and one bracket frictionally engage the front and rear walls of the rail as the clamping member is secured to the brackets.

5 Claims, 3 Drawing Figures

ADJUSTABLE LADDER LEG

BACKGROUND OF THE INVENTION

This invention relates to apparatus for leveling ladders disposed on inclined or irregular surfaces and more particularly to a ladder leveling apparatus readily attachable to ladders having side rails of various configurations without requiring modification to the ladder.

Although it is desirable when erecting a ladder to rest the bottom of the side rails on a substantially flat horizontal surface, it is not uncommon for ladders to be used at locations that do not provide a level surface. Obviously the use of a ladder at such a location can be quite dangerous. Various expedients have been used such as placing blocks or shims under the feet of the side rail to level the ladder, but such temporary devices are quite unsafe.

Ladder levelers attachable to the side rails of ladders have been proposed in the prior art. Such levelers include an extendible leg moveable relative to the rail of the ladder to which it is attached. Examples of such levelers are disclosed in U.S. Pat. Nos. 2,849; 3,484,814; 3,861,500; 3,948,352; 3,998,293; and 4,209,078.

The ladder levelers of the known prior art have been deficient in the manner of attachment thereof to the side rail of a ladder. In certain of the prior art, such as in U.S. Pat. Nos. 3,484,814 and 4,209,078, the leveler can only be clamped to a rectangular leg of a wooden ladder. Modern ladders, however, are usually formed from extruded aluminum having rails of various shaped channel configurations. In certain of the other prior art such as in U.S. Pat. Nos. 2,936,8487; 3,861,500 and 3,948,352, holes must be bored into the ladder rails for bolting or otherwise attaching tubular or channel mounting members to the rail, the mounting members carrying the adjustable leveling leg. Such holes and other modifications required to the rails weaken the ladder and reduce its structural integrity.

SUMMARY OF THE INVENTION

Consquently, it is a primary object of the present invention to provide a ladder leveling leg readily secured to various shaped ladder rails without requiring alteration of the ladder.

It is another object of the present invention to provide a ladder leveling leg having means for securely clamping the leg to variously shaped ladder rails.

It is a further object of the present invention to provide a ladder leveling leg having universal clamping means for fastening the leg to ladder rails of various sizes and configurations, the leg being adjustably carried by the clamping means so as to be adjustable relative to the ladder rail without altering the construction of the rail.

Accordingly, the present invention provides a ladder leveling leg having universal clamping means adapted for fastening to ladder rails of various cross sectional configurations, the leg being adjustably mounted within a guide channel secured to brackets to which a clamping member is adjustably secured to lock the guide channel to the rail of the ladder.

The leveling leg is slidably mounted within the guide channel and secured thereto in selective positions by means of a latching pin resiliently urged to the latching position with cooperating holes in the leg and the channel. The channel is secured to a pair of brackets which in turn are adjustably fastened to a clamping member having means for positively gripping the front and rear walls of substantially any ladder rails when the clamping member is drawn toward the brackets.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
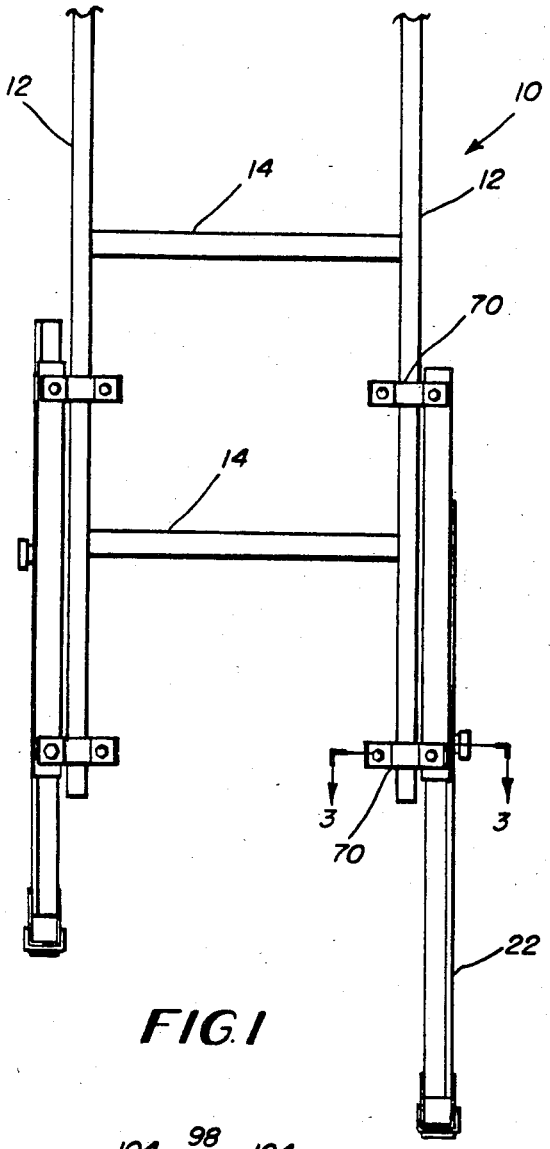
FIG. 1 is a fragmentary front elevational view of the lower portion of a ladder incorporating a leveling leg clamped to each rail and constructed in accordance with the principles of the present invention.
Figure 2:
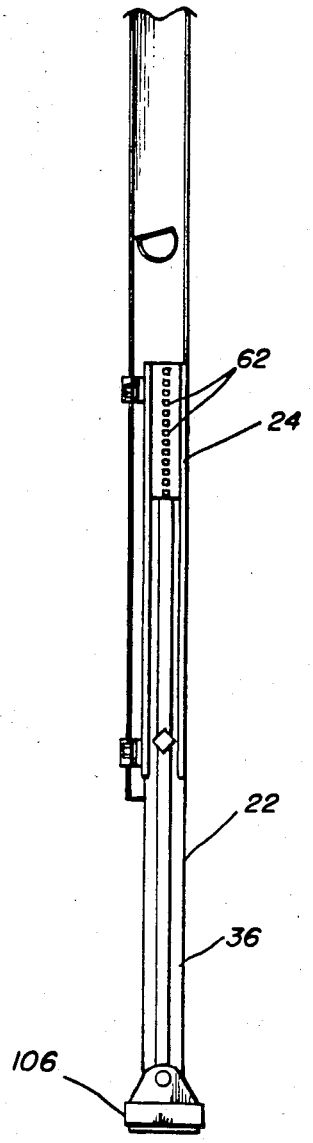
FIG. 2 is a side elevational view as seen from the right side of FIG. 1.
Figure 3:
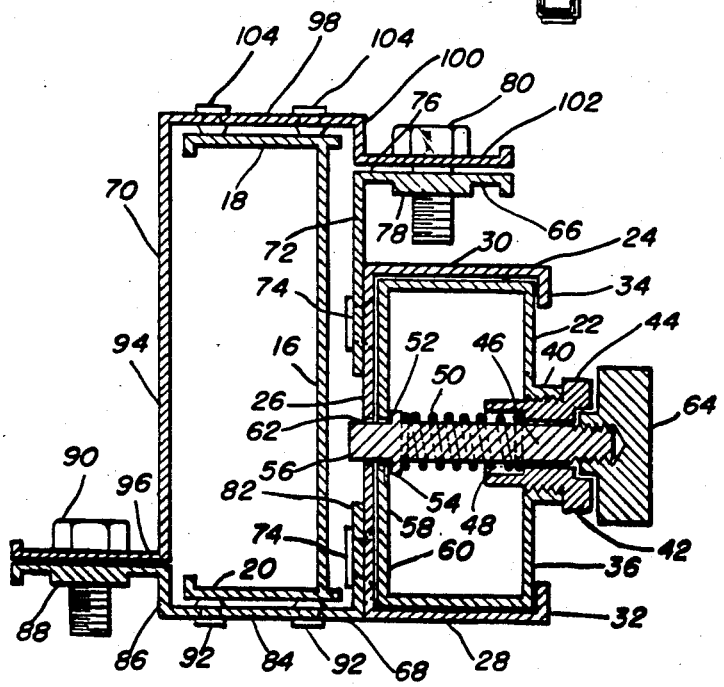
FIG. 3 is a cross sectional view taken substantially along line 3—3 of FIG. 1.

Referring now to the drawings, a portion of a typical ladder 10 is illustrated having side rails 12 connected together by supporting rungs 14. The ladder, as is conventional, may be formed from aluminum, or other such material, extruded into a channel shaped form. As illustrated in FIG. 3 the extruded shape of the rails may include a web 16 extending front to back and a spaced pair of side flanges 18, 20 of any conventional form for providing rigidity to the rails. The precise cross sectional configuration of the rails is not critical to the invention providing the rails have substantially planar front and rear surfaces.

Disposed on the lower portion of at least one of the rails is a leveling leg 22 having a substantially hollow rectangular cross sectional configuration. The leg 22 is slidably mounted within a guide channel 24. The guide channel 24 preferably is an elongated extruded member having a substantially rectangular configuration defined by three walls, 26, 28, 30 and a pair of lips 32, 34 respectively at the end of the walls 28, 30 spaced from the wall 26 and overlying a portion of a respective wall 36 of the leg 22. Formed in the central portion of the wall 36 in a strengthening rib 38 is an internally threaded boss 40. Threadedly disposed in the boss 40 is a plunger guide insert 42 having a central bore 44 for receiving a plunger pin 46. The bore 44 opens into an enlarged counterbore 48 formed in the portion of the insert within the hollow of the leg 22. A compression coil spring 50 is disposed about the pin 46 internally of the wall 36 and seats at one end within the counterbore 48 against the adjacent wall of the insert. A detent member 52 is secured on the interior end of the pin and has a flange 54 which abuts the other end of the spring 50, the detent having a substantially square configuration on the end 56 remote from the spring for receipt within a similar square shaped hole 58 in the wall 60 of the leveling leg 22 opposite the wall 36. A plurality of similar square shaped holes 62 are substantially equally spaced along the wall 26 of the guide channel 24 for receiving the end 56 of the detent member 52 for locking the leveling leg 22 to the channel in any of a number of selected positions as determined by the alignment of the hole 58 with a selected hole 62. The end of the pin 46 remote from the detent 52 is threaded for receiving an operator knob 64. Thus, by pulling on the knob 64 against the force of the spring 50 the end of the detent 52 may be removed from one of the holes 62 and the leg 2 slidably positioned until the end 56 of the detent member is repositioned into another selected hole 62. To mount the leveling leg 22 securely to the rail 12 of the ladder 10, the present invention provides a pair of spaced clamping systems each of which includes a pair of brackets 66, 68 and a clamping member 70, the brackets being secured to the guide channel 24 and adjustably fastened by means of the clamping member to the ladder rail at two spaced locations.

The bracket 66 comprises a substantially L-shaped cross sectional configuration member preferably extruded from aluminum alloy, one of the legs, preferably the longer leg 72, being disposed parallel to and spaced from the rail web 16 and being secured to the wall 26 of the guide channel 24. The leg 72 is secured by means of a rivet 74, or the like, having its head counter-sunk into the wall 26 at a location spaced from one end, e.g., toward the front as illustrated, of the holes 62. The other leg 76 of the bracket 66 has a boss 78 including a tapped hole for receiving a bolt 80 for reasons hereinafter described.

The bracket 68 also comprises a substantially L-shaped extruded member of similar material to the bracket 66. Here, preferably the shorter leg 82, is secured to the wall 26 of the guide channel 24 spaced from the holes 62 remote from the leg 72 also by means of a rivet 74 having a counter-sunk head. The longer leg 84 extends parallel to and spaced slightly from the flange 20 for a substantial portion and has a slight step 86 inwardly substantially parallel to the web 16 from which it continues away from the leg 82, the portion of the leg beyond the step 86 having a boss 88 tapped for receiving a bolt 90. In the portion of the leg 84 adjacent the flange 20 there are mounted at least a pair of non-ferrous metal exploding type rivets 92 which are adapted to bite into and frictionally grip the flange 20 when the leg 84 is drawn tightly toward the flange 20 of the ladder rails as hereinafter described. Of course rubber or synthetic elastomeric grippers may be used in lieu of the exploding type rivets 92, but the exploding rivets are preferred since they have longer lasting qualities.

The clamping member 70 is adjustably secured to the brackets 66 and 68 by means of the bolts 80 and 90. As illustrated, the clamping member 70 comprises an extruded member which complements the shape of the brackets 66, 68 to enclose and grasp about the rail 12. Thus, the clamping member 70 includes a first leg 94 spaced from the ends of the flanges 18 and 20 remote from the web 16, this leg terminating adjacent the bracket 68 in a smaller leg 96 having a bore (not illustrated) adapted to align with the center of the boss 88 for receiving the bolt 90. The other end of the leg 94 extends beyond the flange 80 and a leg 98 extends substantially normal to the leg 94 spaced slightly from and overlying the flange 18, the leg 98 having a small inwardly extending step at 100 and terminating in an extension 102 overlying the leg 76 of the bracket 66. A bore (not illustrated) in the extension 102 is adapted to receive the bolt 80 and be aligned with the tapped hole in the leg 76. A pair of exploding type rivets 104 similar to the rivets 92 are disposed in the leg 98 for frictionally engaging the flange 18 as the leg 98 is drawn toward that flange.

To attach the leveling leg 22 to the rail 12 of the ladder 10, two clamping systems each comprising the brackets 66, 68 and the clamp 70 are utilized. The clamps 70 and bolts 80, 90 are first disassembled from the respective brackets 66, 68 and the brackets are disposed adjacent the web 16 and flange 20 at the desired locations. Each clamp 70 is then disposed so that the bolts 80 and 90 may be inserted through the clamp and secured to the respective bracket 66, 68. As the bolts 80, 90 are threaded into the brackets 66, 68 and the clamp is drawn into assembled relationship therewith, the rivets 92 and 104 are drawn tightly against the respective flange 20 and 18 to lock the clamping system and thus the channel 24 against the rail 12. The leveling leg 22 may thereafter be adjusted relative to the channel 24 by withdrawal of the end 56 of the detent 52 from a first hole 62 and slidably disposing the leg 22 to the desired disposition, whereupon the detent is inserted into another hole 62 at the desired location. A rubber soled safety shoe 106 pivotably mounted at the bottom end of the leveling leg 22 may be provided for fine adjustments of the leg 22.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. Ladder leveling apparatus adapted to be secured to a rail of a ladder, said rail having at least a pair of spaced surfaces separated and interconnected by an outer wall remote from the rungs of the ladder, said apparatus comprising an elongated substantially rectangular hollow guide channel, said guide channel having a first wall including a plurality of holes spaced apart in the direction of elongation, said channel having a second wall spaced from said first wall, an elongated slot formed in said second wall and opening outside said channel, a substantially rectangular elongated leveling leg telescopically disposed within said channel for movement relative to the channel in said direction of elongation, means defining a hole in said leg disposed for alignment with a selected one of the holes in said first wall, releaseable detent means mounted in said leg aligned with said hole in said leg and adapted for entry through said hole and a selected one of the holes in said channel, said detent means including a control member extending through said leg and said elongated slot for access by an operator, and at least a pair of spaced clamping means for securing said guide channel to the rail at spaced locations, each clamping means comprising bracket means secured to said channel and a clamp adjustably fastened to said bracket means, said clamp and said bracket means including frictional gripper members for tightly grasping said pair of spaced surfaces of said rail when said clamp is fastened to said bracket means.

2. Ladder leveling apparatus as recited in claim 1, wherein said bracket means comprises a first bracket member having a first leg secured to said first wall of said channel adjacent to the outer wall of said rail and a second leg disposed angularly relative to said first leg, a second bracket member having a first leg secured to said first wall of said channel adjacent the outer wall of said rail and a second leg disposed angularly relative thereto and extending away from said channel adjacent to and beyond one of the spaced surfaces of said rail, said second leg of said second bracket carrying a first set of frictional gripper members projecting therefrom for abutment with said one of the spaced surfaces, said clamp comprising a clamping member having a first leg carrying another set of frictional gripper members projecting therefrom for abutment with the other of the spaced surfaces of said rail, and adjustable fastening means for fastening said clamping member to said second leg of each of said first and second brackets to draw all of said frictional gripper members tightly against the respective surface of said rail.

3. Ladder leveling apparatus as recited in claim 2, wherein said releasable detent means comprises a pin, a detent receivable within said holes mounted on one end of said pin and said control member being secured to the other end of said pin, a coil compression spring disposed about said pin, said spring having one end abutting said detent for forcing said detent toward said first wall of said channel, and an abutment surface in said leveling leg, the other end of said coil spring being seated against said abutment surface, whereby said detent may be withdrawn from a selected hole upon pulling said control member away from said first wall of said channel to permit movement of said leveling leg within said channel.

4. Ladder leveling apparatus as recited in claim 2, wherein said first leg of said clamping member extends away from said channel beyond the surfaces of said rail and terminates in a second leg, said second leg of said clamping member extending toward the second leg of said second bracket, said adjustable fastening means including threaded means for connecting the first leg of said clamping member to the second leg of said first bracket and for connecting the second leg of said clamping member to the second leg of said second bracket.

5. Ladder leveling apparatus as recited in claim 4, wherein said releasable detent means comprises a pin, a detent receivable within said holes mounted on one end of said pin and said control member being secured to the other end of said pin, a coil compression spring disposed about said pin, said spring having one end abutting said detent for forcing said detent toward said first wall of said channel, and an abutment surface in said leveling leg, the other end of said coil spring being seated against said abutment surface, whereby said detent may be withdrawn from a selected hole upon pulling said control member away from said first wall of said channel to permit movement of said leveling leg within said channel.

* * * * *

UNITED STATES PATENT AND TRADEMARK OFFICE

CERTIFICATE OF CORRECTION

PATENT NO. : 4,606,432

DATED : August 19, 1986

INVENTOR(S) : Ned W. Belt

It is certified that error appears in the above-identified patent and that said Letters Patent is hereby corrected as shown below:

Column 1, line 23, "2,849" should be - - 2,936,849 - -

Signed and Sealed this

Eleventh Day of November, 1986

*Attest:*

DONALD J. QUIGG

*Attesting Officer*

*Commissioner of Patents and Trademarks*